US011131448B1

(12) United States Patent
Ensley

(10) Patent No.: US 11,131,448 B1
(45) Date of Patent: Sep. 28, 2021

(54) MOVEMENT ACTIVATED ILLUMINATION DEVICE

(71) Applicant: Dewey Randall Ensley, Odenville, AL (US)

(72) Inventor: Dewey Randall Ensley, Odenville, AL (US)

( * ) Notice: Subject to any disclaimer, the term of this patent is extended or adjusted under 35 U.S.C. 154(b) by 0 days.

(21) Appl. No.: 17/034,493

(22) Filed: Sep. 28, 2020

(51) Int. Cl.

| | |
|---|---|
| ***F21V 23/04*** | (2006.01) |
| ***F21V 33/00*** | (2006.01) |
| ***A63F 9/04*** | (2006.01) |
| ***A63B 43/00*** | (2006.01) |
| ***A63B 43/06*** | (2006.01) |

(52) U.S. Cl.
CPC ..... *F21V 23/0492* (2013.01); *A63B 43/008* (2013.01); *A63B 43/06* (2013.01); *A63B 2225/74* (2020.08); *A63F 9/0468* (2013.01); *F21V 33/008* (2013.01); *Y10S 273/14* (2013.01); *Y10S 362/802* (2013.01); *Y10S 362/809* (2013.01)

(58) Field of Classification Search
CPC ... F21V 33/008; F21V 23/0492; A63B 43/06; A63B 2225/74; A63B 43/008; A63F 9/0468; Y10S 362/802; Y10S 362/809; Y10S 273/14
See application file for complete search history.

(56) References Cited

U.S. PATENT DOCUMENTS

| | | | | | |
|---|---|---|---|---|---|
| 2,849,819 | A * | 9/1958 | Murphy | A63H 33/00 | 446/153 |
| 2,903,820 | A * | 9/1959 | Bodell | A63B 43/06 | 446/439 |
| 3,304,651 | A * | 2/1967 | Deyerl | A63B 43/06 | 446/439 |
| 5,388,825 | A * | 2/1995 | Myers | A63B 43/06 | 473/570 |
| 5,725,445 | A * | 3/1998 | Kennedy | A63B 43/06 | 473/570 |
| 9,557,038 | B2 * | 1/2017 | Blair | F21S 9/02 | |
| 2001/0049311 | A1 * | 12/2001 | Lewis | A63B 43/06 | 473/570 |
| 2003/0202362 | A1 * | 10/2003 | Liou | A63B 37/0003 | 362/555 |
| 2004/0160000 | A1 * | 8/2004 | Lindsey | A63F 9/0468 | 273/146 |
| 2005/0261083 | A1 * | 11/2005 | Liao | A63B 24/0021 | 473/353 |
| 2009/0040761 | A1 * | 2/2009 | Huang | A63B 43/06 | 362/253 |
| 2010/0066550 | A1 * | 3/2010 | Mottram | F21V 23/0414 | 340/644 |
| 2010/0072895 | A1 * | 3/2010 | Glynn | H05B 41/34 | 315/76 |
| 2012/0223477 | A1 * | 9/2012 | Zylkin | A63F 9/0468 | 273/146 |

(Continued)

*Primary Examiner* — Alexander K Garlen
*Assistant Examiner* — Colin J Cattanach
(74) *Attorney, Agent, or Firm* — The Iwashko Law Firm, PLLC; Lev Ivan Gabriel Iwashko

(57) ABSTRACT

A movement activated illumination device, including a main body comprising a cube shape, a plurality of illumination units disposed on each side of the main body to turn on and illuminate a surrounding area in response to the main body being thrown, and a power button to turn off the plurality of illumination units in response to being depressed.

6 Claims, 1 Drawing Sheet

(56) References Cited

U.S. PATENT DOCUMENTS

| | | | | |
|---|---|---|---|---|
| 2013/0120989 | A1* | 5/2013 | Sun | F21V 23/0464 362/244 |
| 2014/0268700 | A1* | 9/2014 | Mumma | F21V 3/06 362/183 |
| 2015/0014923 | A1* | 1/2015 | Muse | A63F 9/0415 273/146 |
| 2016/0325166 | A1* | 11/2016 | Wallace | A63B 69/0071 |
| 2016/0356438 | A1* | 12/2016 | Matson | F42B 12/42 |
| 2018/0181654 | A1* | 6/2018 | Young | G06F 16/68 |
| 2018/0333638 | A1* | 11/2018 | Read | A63F 9/0468 |
| 2020/0016481 | A1* | 1/2020 | Stathakis | A63F 9/0468 |

* cited by examiner

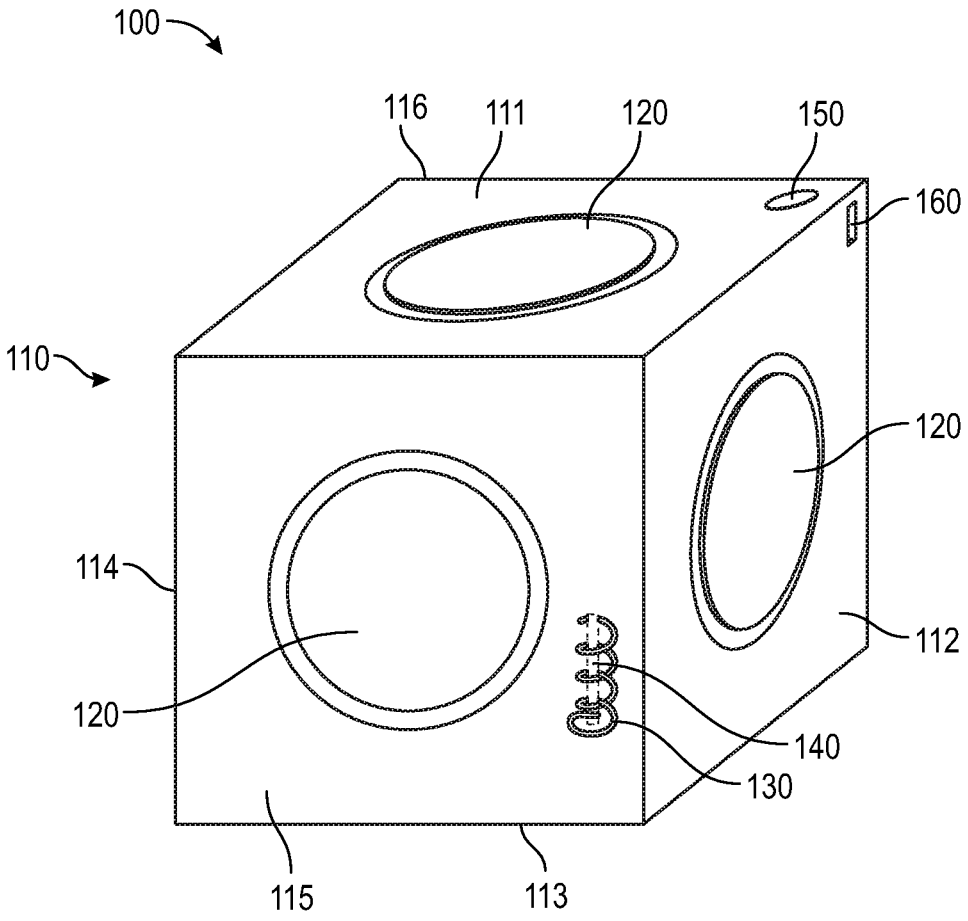
100
116
111
120
150
160
110
120
114
112
120
140
130
115
113

MOVEMENT ACTIVATED ILLUMINATION DEVICE

BACKGROUND

1. Field

The present general inventive concept relates generally to an illumination device, and particularly, to a movement activated illumination device.

2. Description of the Related Art

Proper lighting is a necessity for a person to safely navigate within any space with low level lighting and/or no lighting, as it permits the person to view a surrounding area. Consequently, an area with no lighting can cause injury due to the person striking an object that the person could not see in the dark.

Additionally, there are occasions where such immediate lighting is not easy to access. As such, the person may feel trapped and/or helpless to move about safely without risk of harm.

Therefore, there is a need for a movement activated illumination device that can be dispersed in a dark environment.

SUMMARY

The present general inventive concept provides a movement activated illumination device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a movement activated illumination device, including a main body comprising a cube shape, a plurality of illumination units disposed on each side of the main body to turn on and illuminate a surrounding area in response to the main body being thrown, and a power button to turn off the plurality of illumination units in response to being depressed.

Each side of the main body may be detachably connected to each other side of the main body.

Each of the plurality of illumination units may illuminate independently with respect to each other.

The plurality of illumination units may illuminate simultaneously.

The movement activated illumination device may further include at least one spring disposed within at least a portion of the main body to vibrate in response to the main body being thrown, and at least one contact pin disposed within at least a portion of the main body to be contacted by the at least one spring in response to the vibration of the at least one spring, such that the plurality of illumination units illuminate in response to the at least one spring contacting the at least one contact pin.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates a perspective view of a movement activated illumination device, according to an exemplary embodiment of the present general inventive concept.

DETAILED DESCRIPTION

Various example embodiments (a.k.a., exemplary embodiments) will now be described more fully with reference to the accompanying drawings in which some example embodiments are illustrated. In the FIGURES, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Movement Activated Illumination Device 100
Main Body 110
First Side 111
Second Side 112
Third Side 113

Fourth Side 114
Fifth Side 115
Sixth Side 116
Illumination Units 120
Spring 130
Contact Pin 140
Power Button 150
Power Source 160

FIG. 1 illustrates a perspective view of a movement activated illumination device 100, according to an exemplary embodiment of the present general inventive concept.

The movement activated illumination device 100 may be constructed from at least one of metal, plastic, wood, and rubber, etc., but is not limited thereto. Also, the movement activated illumination device 100 may be highly durable and waterproof.

The movement activated illumination device 100 may include a main body 110, a plurality of illumination units 120, at least one spring 130, at least one contact pin 140, a power button 150, and a power source 160, but is not limited thereto.

Referring to FIG. 1, the main body 110 is illustrated to have a rectangular prism shape. However, the main body 110 may be bell-shaped, rectangular, circular, conical, triangular, pentagonal, hexagonal, heptagonal, octagonal, or any other shape known to one of ordinary skill in the art, but is not limited thereto.

The main body 110 may include a first side 111, a second side 112, a third side 113, a fourth side 114, a fifth side 115, and a sixth side 116, but is not limited thereto.

The first side 111, the second side 112, the third side 113, the fourth side 114, the fifth side 115, and/or the sixth side 116 may have equivalent dimensions (e.g., a length and a width), such that the main body 110 is a cube. Moreover, the first side 111, the second side 112, the third side 113, the fourth side 114, the fifth side 115, and/or the sixth side 116 may be detachably connected to each other along each edge, such as by interlocking joints and/or snapping joints.

Alternatively, each edge of the first side 111, the second side 112, the third side 113, the fourth side 114, the fifth side 115, and/or the sixth side 116 may be slidably inserted into a rail frame. In other words, the main body 110 may consist of the rail frame having the cube shape to receive each of the first side 111, the second side 112, the third side 113, the fourth side 114, the fifth side 115, and/or the sixth side 116 therein.

Furthermore, the first side 111, the second side 112, the third side 113, the fourth side 114, the fifth side 115, and/or the sixth side 116 may be transparent and/or opaque.

Each of the plurality of illumination units 120 may include a light, but is not limited thereto.

Each light of the plurality of illumination units 120 may include an incandescent bulb and/or a light-emitting diode (LED), but is not limited thereto. Each of the plurality of illumination units 120 may illuminate a surrounding area in response to turning on.

Also, each light of the plurality of illumination units 120 may be replaced subsequent to removal of the first side 111, the second side 112, the third side 113, the fourth side 114, the fifth side 115, and/or the sixth side 116 corresponding to the light therein.

The at least one spring 130 may be disposed within at least a portion of the main body 110.

The at least one contact pin 140 may be disposed within at least a portion of the main body 110, such that the contact pin 140 may be within and/or between a coil of the at least one spring 130.

The power button 150 may be disposed on at least a portion of the main body 110, such as an outer surface of the first side 111 of the main body 110. The power button 150 may turn off the plurality of lights 120 in response to being depressed. However, the power button 150 does not turn on the plurality of illumination units 120 in response to being depressed.

The power source 160 may include a battery, a solar cell, and a power inlet, but is not limited thereto.

The battery of the power source 160 may include a rechargeable battery that may be charged in response to receiving external power, such as an external light source providing light to the solar cell and/or an external outlet connected via a power cord to the power inlet.

The power source 160 may provide power to the plurality of illumination units 120 and/or the power button 150.

Each of the plurality of illumination units 120 may turn on and illuminate in response to the main body 110 being moved (i.e. thrown, kicked, dropped, etc.). More specifically, the plurality of illumination units 120 may illuminate in response to being moved, such that the at least one spring 130 vibrates and contacts the at least one contact pin 140 to complete a circuit between the plurality of illumination units 120 and/or the power source 160. In other words, the at least one contact pin 140 may receive a contact of the at least one spring 130 in response to vibration by the at least one spring 130.

Also, the plurality of illumination units 120 may turn and illuminate in response to activation by a piezoelectric unit. In other words, the piezoelectric unit may be disposed within the main body 110 to generate electricity in response to movement of the main body 110.

Alternatively, the at least one spring 130 and/or the at least one contact pin 140 may be provided in plurality to correspond to each of the plurality of illumination units 120. As such, each of the plurality of illumination units 120 may illuminate simultaneously and/or independently with respect to each of the other illumination units 120 based on whether the at least spring 130 corresponding to each of the plurality of illumination units 120 contacts the at least one contact pin 140. Therefore, independent operation of each of the plurality of illumination units 120 may conserve power loss from the battery of the power source 160. For example, the illumination unit 120 on the first side 111 may illuminate in response to the at least one spring 130 contacting the at least one contact pin 140 corresponding to the first side 111, but the illumination unit 120 on the fourth side 114 may remain off due to the at least one spring 130 remaining still (i.e. not moving) on the fourth side 114.

Therefore, the movement activated illumination device 100 may be used to illuminate a dark environment by being thrown, such that a user does not risk injury by moving in the dark.

The present general inventive concept may include a movement activated illumination device 100, including a main body 110 comprising a cube shape, a plurality of illumination units 120 disposed on each side of the main body 110 to turn on and illuminate a surrounding area in response to the main body 110 being thrown, and a power button 150 to turn off the plurality of illumination units 120 in response to being depressed.

Each side of the main body 110 may be detachably connected to each other side of the main body 110.

Each of the plurality of illumination units 120 may illuminate independently with respect to each other.

The plurality of illumination units 120 may illuminate simultaneously.

The movement activated illumination device 100 may further include at least one spring 130 disposed within at least a portion of the main body 110 to vibrate in response to the main body 110 being thrown, and at least one contact pin 140 disposed within at least a portion of the main body 110 to be contacted by the at least one spring 130 in response to the vibration of the at least one spring 130, such that the plurality of illumination units 120 illuminate in response to the at least one spring 130 contacting the at least one contact pin 140.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A movement activated illumination device, comprising:

a main body comprising a cube shape;

a plurality of illumination units disposed on each side of the main body to turn on and illuminate a surrounding area in response to a change in momentum of the main body as a result of being thrown, such that each of the plurality of illumination units remain on during the change in momentum corresponding to a side of the main body responding to the change in momentum, such that at least one of the plurality of illumination units disposed on another side of the main body remains off during the change in momentum of the main body as a result of an absence of a change in momentum of the another side of the main body; and a power button to turn off the plurality of illumination units in response to being depressed.

2. The movement activated illumination device of claim 1, wherein each side of the main body is detachably connected to each other side of the main body.

3. The movement activated illumination device of claim 1, wherein each of the plurality of illumination units illuminate independently with respect to each other.

4. The movement activated illumination device of claim 1, wherein the plurality of illumination units illuminate simultaneously.

5. The movement activated illumination device of claim 1, further comprising:

at least one spring disposed within at least a portion of the main body to vibrate in response to the main body being thrown; and at least one contact pin disposed within at least a portion of the main body to be contacted by the at least one spring in response to the vibration of the at least one spring, such that the plurality of illumination units illuminate in response to the at least one spring contacting the at least one contact pin.

6. A movement activated illumination device, comprising:

a main body comprising a cube shape;

a plurality of illumination units disposed only at a center of each side of the main body;

a plurality of springs connected to and corresponding to each of the plurality of illumination units;

a plurality of contact pins connected to and corresponding to each of the plurality of springs to illuminate at least one of the plurality of illumination units based on vibration of at least one of the plurality of springs corresponding to a side of the main body responding to a change in momentum, such that at least one of the plurality of illumination units disposed on another side of the main body remains off during the change in momentum of the main body as a result of an absence of a change in momentum of the another side of the main body; and a power button to turn off the plurality of illumination units in response to being depressed, such that the plurality of illumination units remain off in response to being depressed while the plurality of illumination units are off.

* * * * *